US005970278A

United States Patent [19]

Munakata

[11] Patent Number: 5,970,278

[45] Date of Patent: Oct. 19, 1999

[54] IMAGE FORMING APPARATUS INCLUDING AN INTERMEDIATE TRANSFER BODY CLEANING MECHANISM

[75] Inventor: Leo Munakata, Kanagawa, Japan

[73] Assignee: Ricoh Company, Ltd., Tokyo, Japan

[21] Appl. No.: 09/020,143

[22] Filed: Feb. 6, 1998

[30] Foreign Application Priority Data

Feb. 7, 1997 [JP] Japan ..... 9-040155

[51] Int. Cl.[6] ..... G03G 15/00

[52] U.S. Cl. ..... 399/46; 399/66; 399/71; 399/101; 399/297

[58] Field of Search ..... 399/297, 66, 71, 399/101, 298, 299, 300, 302, 303, 46

[56] References Cited

U.S. PATENT DOCUMENTS 5,572,303 11/1996 Arimoto ..... 399/303

5,600,405 2/1997 Umeda et al. ..... 399/71

*Primary Examiner*—Arthur T. Grimley
*Assistant Examiner*—William A Noé
*Attorney, Agent, or Firm*—Oblon, Spivak, McClelland, Maier & Neustadt, P.C.

[57] ABSTRACT

An image forming apparatus of the type capable of forming a plurality of images in separate areas of an intermediate transfer body is disclosed. When a paper or similar recording medium to which a toner image formed on the intermediate transfer body should be transferred is absent, the transfer of a toner image from the image carrier to the intermediate transfer body is interrupted. At the same time, toner left on the intermediate transfer body is removed by a particular method different from a usual method and capable of enhancing a cleaning ability. The apparatus is therefore capable of fully removing the toner and thereby obviating defective images.

12 Claims, 7 Drawing Sheets

IMAGE FORMING APPARATUS INCLUDING AN INTERMEDIATE TRANSFER BODY CLEANING MECHANISM

BACKGROUND OF THE INVENTION

The present invention relates to an electophotographic copier, laser printer, facsimile apparatus or similar image forming apparatus and, more particularly, to an image forming apparatus capable of forming a plurality of images in separate areas of an intermediate transfer body.

It is a common practice with an electrophotographic image forming apparatus to transfer a toner image from a photoconductive element to a paper or similar recording medium and then fix the toner image on the paper. In another image forming apparatus known in the art, the toner image is transferred from the photoconductive element to the paper by way of an intermediate transfer body. Assume that the image forming apparatus of the type including the intermediate image transfer body is operated with papers whose size is less than one half of the maximum paper size available with the apparatus. Then, a plurality of toner images may be transferred to separate areas of the transfer body and then sequentially transferred to consecutive papers in order to increase the continuous processing speed, as taught in, e.g., Japanese Patent Laid-Open Publication No. 7-72701. This document additionally discusses various timings for turning on cleaning means assigned to the transfer body in the event of the above continuous transfer of the toner images to consecutive papers.

So long as papers are sequentially fed in synchronism with the toner images transferred to the intermediate transfer body, the above conventional method for cleaning the intermediate body is successful. However, even when papers are absent, the next toner image is formed on the photoconductive element or image carrier. In this case, the amount of toner constituting the toner image is too great to be fully removed by the usual ability of the cleaning means. Toner left on the intermediate body would be added to toner to be transferred from the image carrier to the transfer body at the next image forming procedure, resulting in a defective image.

SUMMARY OF THE INVENTION

It is therefore an object of the present invention to provide an image forming apparatus capable of interrupting, when a recording medium for transferring a toner image from an intermediate transfer body is absent, the transfer of a toner image from an image carrier to the transfer body, and cleaning the intermediate body with a particular method which enhances a cleaning ability and thereby obviates defective images.

An image forming apparatus of the present invention and capable of sequentially transferring a plurality of toner images to respective areas of an intermediate transfer body separate in the circumferential direction of the transfer body, and sequentially transferring the toner images to respective recording media includes an image carrier for forming a toner image thereon, and the intermediate transfer body to which the toner image is transferred from the image carrier. A cleaning unit removes toner left on the intermediate transfer body. A medium sensing section determines whether or not a recording medium for transferring the toner image existing on the intermediate transfer body is present. A cleaning switching section interrupts, when the medium sensing section determines that the recording medium is absent, the transfer of the toner image from the image carrier to the intermediate transfer body, and causes the cleaning unit to clean the transfer body by a particular method different from a usual method.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENT

Figure 1:
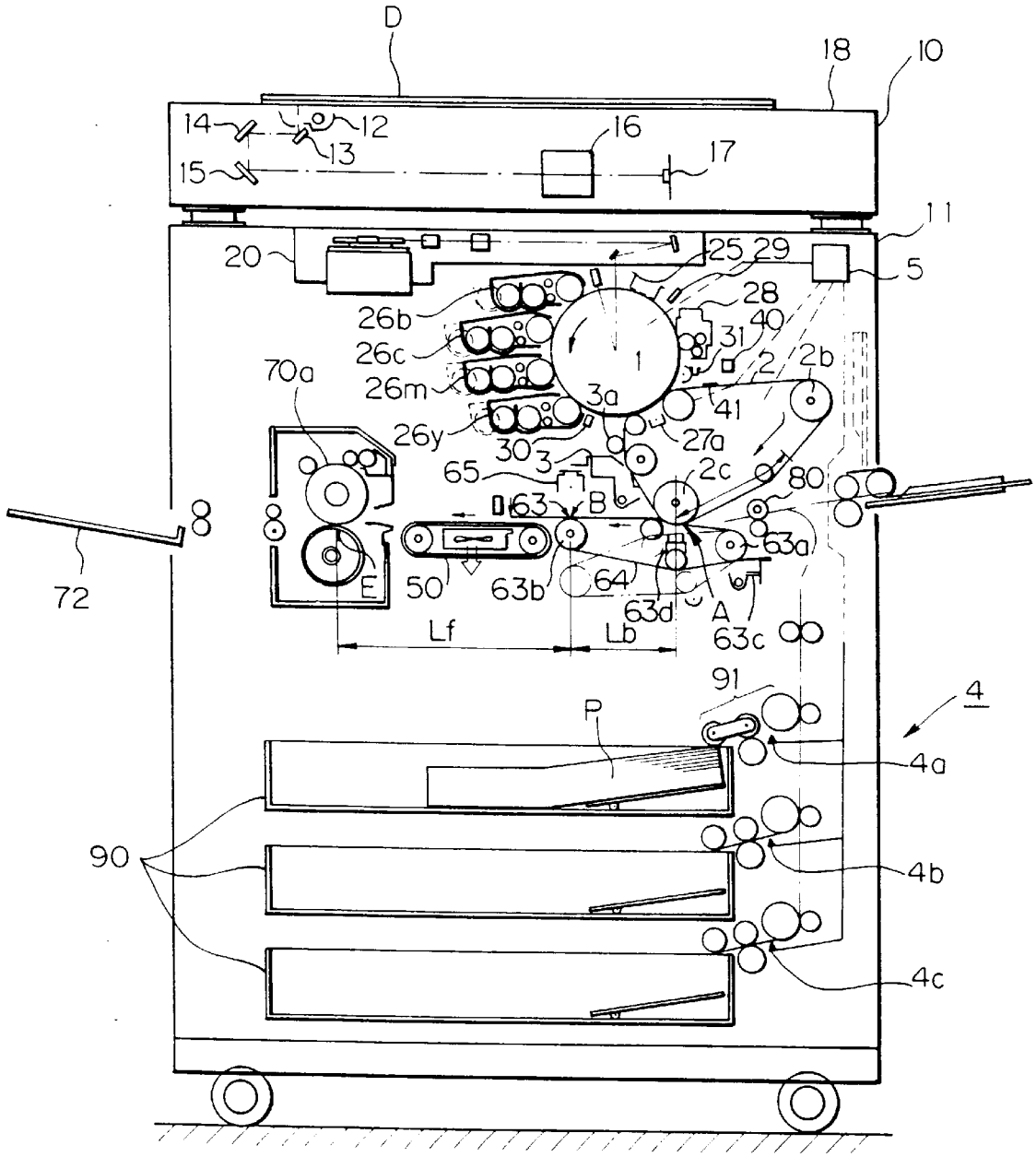
FIG. 1 is a sectional front view of an image forming apparatus embodying the present invention.

Referring to FIG. 1 of the drawings, an image forming apparatus embodying the present invention is shown and implemented as an electrophotographic color copier by way of example. Structural parts and elements not directly relevant to the understanding of the present invention will not be shown or described. As shown, the color copier is generally made up of a color scanner or image reading device 10 and a color printer or color image recording device 11.

The color scanner 10 includes a lamp 12, mirrors 13, 14 and 15, a lens 16, and a color image sensor 17. While the lamp 12 illuminates a document D laid on a glass platen 18, the resulting reflection is incident to the color image sensor 17 via the mirrors 13–15 and lens 16. The image sensor 17 transforms the incident light to, e.g., an R (red), a G (green) and a B (blue) electric image signal. An image processing section, not shown, converts the R, G and B image signals to Bk (black), C (cyan), M (magenta) and Y (yellow) color image data on the basis of the intensity levels of the R, G and B signals.

The color printer 11 includes an optical writing unit 20. The writing unit 20 transforms the color image data received from the color scanner 10 to a corresponding optical signal and writes the document image on a photoconductive drum or image carrier 1 with the optical signal. As a result, a latent image representative of the document image is electrostatically formed on the drum 1. The drum 1 is rotated counterclockwise, as indicated by an arrow in FIG. 1. Arranged around the drum 1 are a drum cleaning unit 28, a discharge lamp 29, a charger 25, a Bk developing unit 26*b*, a C developing unit 26*c*, an M developing unit 26*m*, a Y developing unit 26*y*, a pattern sensor 30 responsive to a particular pattern formed on the drum 1, a precleaning discharger 31, and an intermediate transfer body implemented as a belt 2.

A cleaning switching section or switching means 5 is a characteristic feature of the illustrative embodiment. A paper sensing section or medium sensing means 4 includes sensing means 4*a*, 4*b* and 4*c* respectively associated with three paper cassettes 90 loaded with papers P. The sensing means 4*a*–4*c* each is responsive to the paper P fed out from the associated cassettes 90 by a pick-up roller 91. The outputs of the sensing means 4*a*–4*c* are sent to the cleaning switching section 5.

A marker 41 is formed on the belt 2 for the detection of the position of the belt 2. A marker sensor 40 responsive to the marker 41 is located at a suitable position adjacent to the belt 2. The belt 2 has a circumferential length selected to be at least the sum of an image length corresponding the maximum paper length available with the copier and a margin selected in consideration of, among others, the switching speed of the individual developing unit.

The operation of the color copier will be described on the assumption that Bk, C, M and Y images are sequentially formed in this order by way of example. On the start of a copying operation, the color scanner 10 starts reading the Bk image data out of the document D at a preselected timing. At the same time, a drum drive mechanism, not shown, causes the drum 1 to rotate counterclockwise while the charger 25 uniformly charges the surface of the drum 1. The belt 2 is caused to rotate clockwise at the same time as the drum 1 is caused to rotate counterclockwise. The marker sensor 40 senses the marker 41 of the belt 2 in rotation and outputs a signal representative of the marker 41. Then, on the elapse of a preselected period of time, the writing unit 20 forms a latent image represented by the Bk image data on the drum 1 with a laser beam, thereby forming a latent image. Let the latent image derived from the Bk image data be referred to as a Bk latent image. Also, let latent images derived from the C, M and Y image data be referred to as a C, an M and a Y latent image, respectively.

To develop the Bk latent image from its leading edge, the Bk developing unit 26*b* is rendered operative before the leading edge of the Bk latent image arrives at a developing position assigned to the unit 26*b*. Then, the developing unit 26*b* sequentially develops the Bk latent image with Bk toner. As soon as the trailing edge of the Bk latent image moves away from the above developing position, the Bk developing unit 26*b* is rendered inoperative. Such Bk development is completed at least before the leading edge of the next or C latent image arrives at the same developing position. It is to be noted that the developing units 26*b*, 26*c*, 26*m* and 26*y* each is movable toward and away from the drum 1, i.e., between a position indicated by a solid line and a position indicated by a phantom line. For this purpose, a developing unit moving mechanism including, e.g., an eccentric cam and a clutch is used although not shown specifically.

The Bk toner image formed on the drum 1 is transferred to the surface of the belt 2 being rotated at the same speed as the drum 1. The image transfer from the drum 1 to the belt 2 will be referred to as primary transfer hereinafter. For the primary transfer, a charger 27*a* for primary transfer effects discharge while the drum 1 and belt 2 are held in contact with each other. That is, the Bk toner image is formed on the belt 2 over an area defined on the basis of the position of the marker 41.

Subsequently, the color scanner 10 outputs the C image data at a preselected timing as during the Bk scanning procedure. The belt 2 is continuously rotated even after the Bk developing step. On one full turn of the belt 2, the marker sensor 40 again senses the marker 41. Then, on the elapse of the preselected period of time, the writing unit 20 forms a C latent image on the drum 1 in accordance with the C image data. After the trailing edge of the Bk image has moved away from a developing position assigned to the C developing unit 26*c*, but before the leading edge of the C latent image arrives at the above position, the developing unit 26*c* is rendered operative and develops the C latent image with C toner.

The toner image formed on the drum 1 is transferred to the belt 2 (primary transfer) being rotated in contact with the drum 1. In the illustrative embodiment, the Bk and C latent images both are formed on the drum 1 on the basis of the output of the marker sensor 40. Therefore, even if the consecutive Bk and C latent images are formed in different areas on the drum 1, they are surely transferred to the same area of the belt 2 in accurate register with each other. Development with M toner and Y toner occurs in exactly the same manner as the above development with Bk and C toner and will not be described in order to avoid redundancy.

The Bk, C, M and Y toner images sequentially formed on the drum 1 are sequentially transferred to the same area of the belt 2 by the above procedure, completing a composite four-color or full-color image. The full-color image is transferred from the belt 2 to the paper P at one time. This image transfer will be referred to as secondary transfer hereinafter.

The configuration of a belt unit including the belt 2 will be described specifically. As shown, the belt 2 is passed over a drive roller 2*b*, a secondary transfer back-up roller 2*c*, and driven rollers. A drive motor, not shown, causes the belt 2 to move in the previously mentioned direction at the same speed as the drum 1 via the drive roller 2*b*. A belt cleaning unit or belt cleaning means 3 is made up of a rubber blade 3*a* and a mechanism, not shown, for moving the rubber blade 3*a* into and out of contact with the belt 2. The rubber blade 3*a* is spaced from the belt 2 from the start of the printing operation to the end of primary transfer of the leading edge of the Y or last image. After the secondary transfer of the leading edge of the full-color image formed on the belt 2, but before the corresponding portion of the belt 2 bearing the leading edge of the image reaches the cleaning unit 3, the above mechanism moves the rubber blade 3*a* into contact with the belt 2, thereby cleaning the belt 2.

In the illustrative embodiment, a conveyor belt unit or secondary image transfer means 63 has a conveyor belt 64 passed over a drive roller 63*a*, a driven roller 63*b*, and back-up rollers. The conveyor belt 64 is formed of Mylar, PVDF (polyvinylidene fluoride) or similar insulating material. A cleaning blade 63*c*, a charger 65 for discharging the paper P and a charger 66 for discharging the conveyor belt 64 are arranged around the belt 64. The paper P is fed from any one of the cassettes 90 by the paper separating and feeding mechanism 91 and once brought to a stop by a registration roller 80.

As the full-color toner image is being completed on the belt 2 by the consecutive primary transfer, the paper P is driven by the registration roller 80 such that it meets the leading edge of the toner image. The conveyor belt 64 conveys the paper P to a secondary transfer position A. At this instant, a charger 63*d* positioned at the rear of the conveyor belt 64 charges the belt 64 to the polarity opposite to the polarity of the toner image. Consequently, the toner image is transferred from the belt 2 to the paper P at a time. The paper P with the toner image is discharged by the discharger 65 and separated from the conveyor belt 64 thereby. A conveying device 50 including a belt and using suction conveys the paper P separated from the belt 64 to a fixing unit 70. After the toner image has been fixed on the paper P by the fixing unit 70, the paper or copy P is driven out to a tray 72.

Figure 2A:
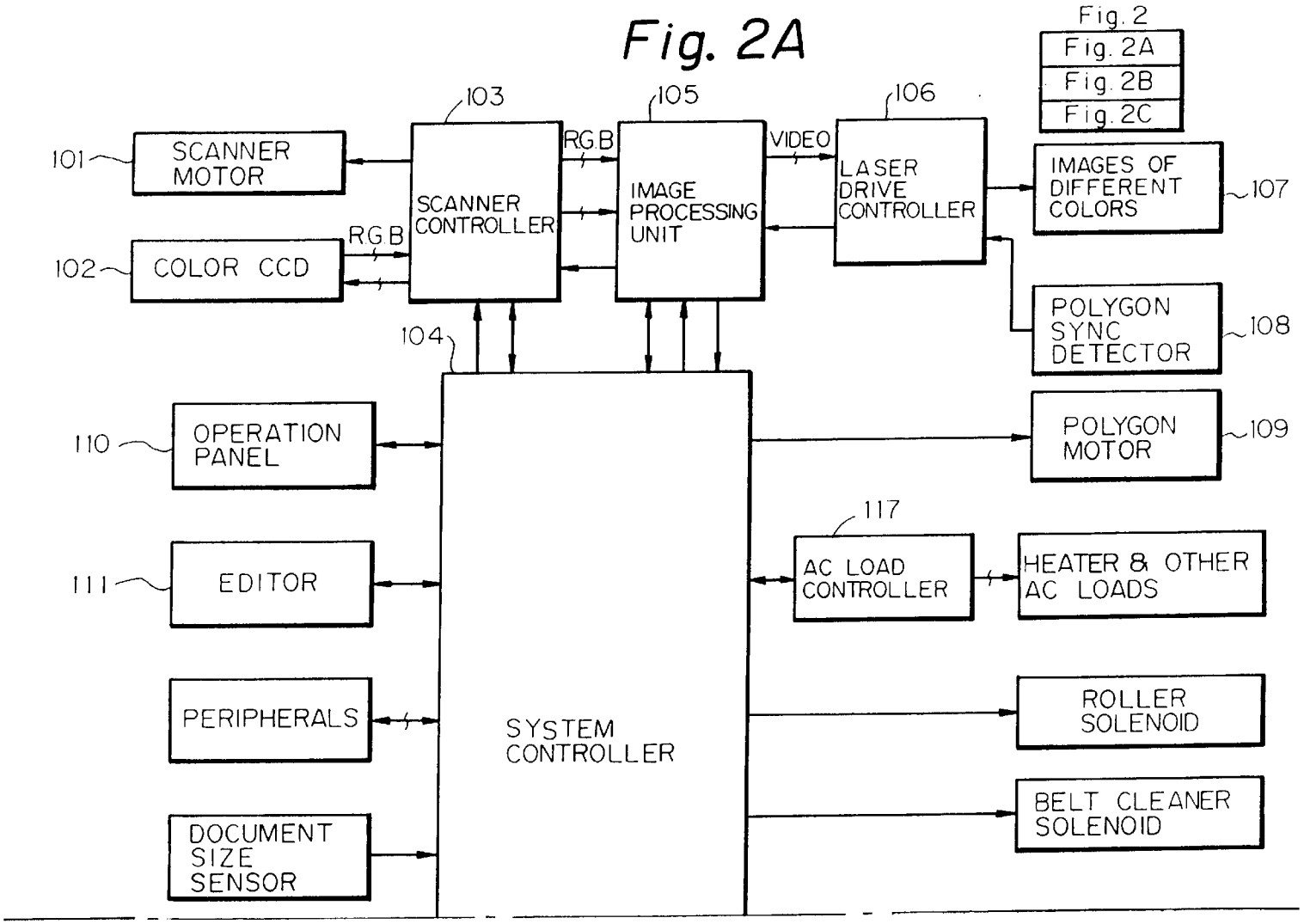
FIG. 2 a block diagram schematically showing a control system included in the illustrative embodiment.
Figure 2B:
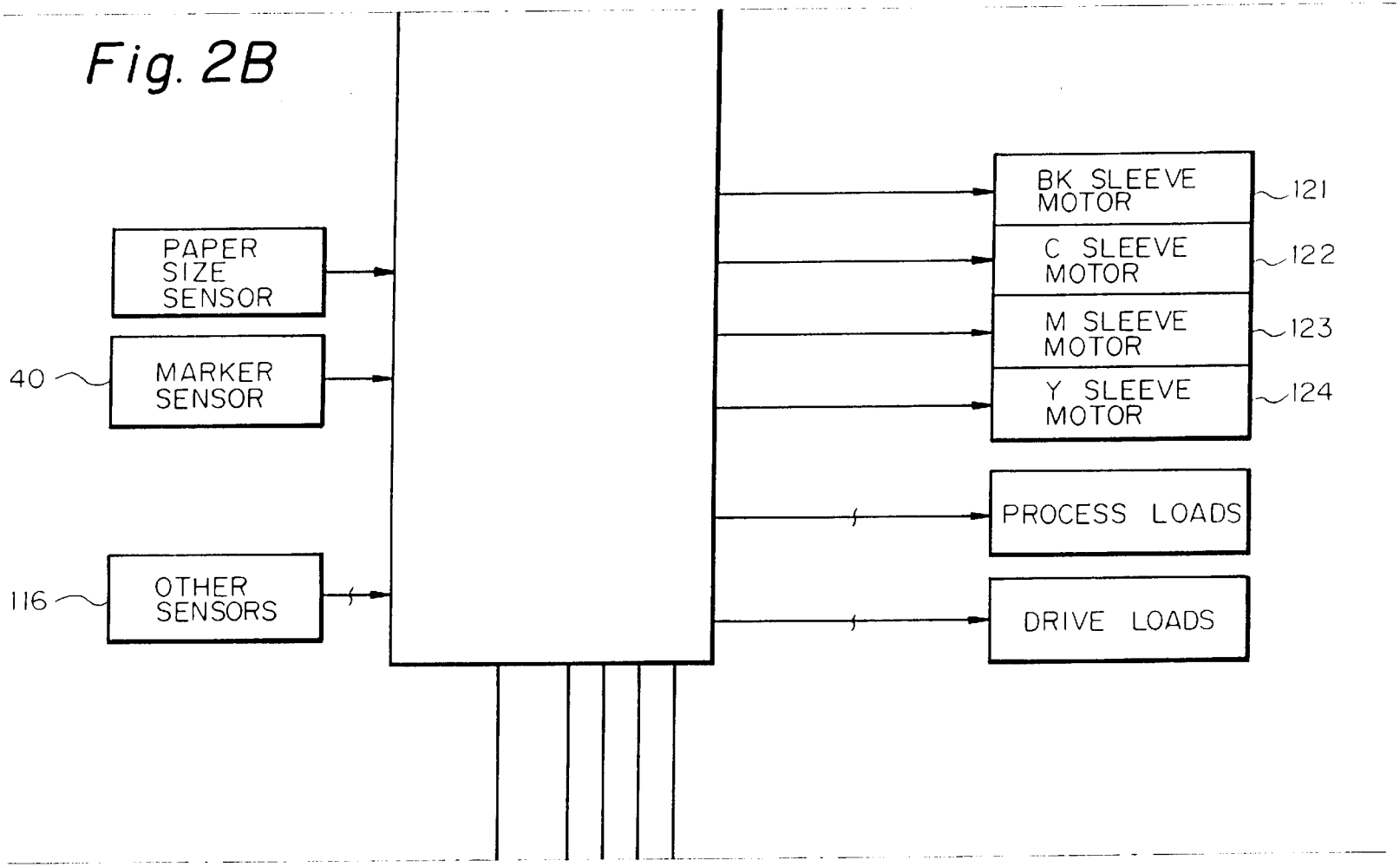
Figure 2C:
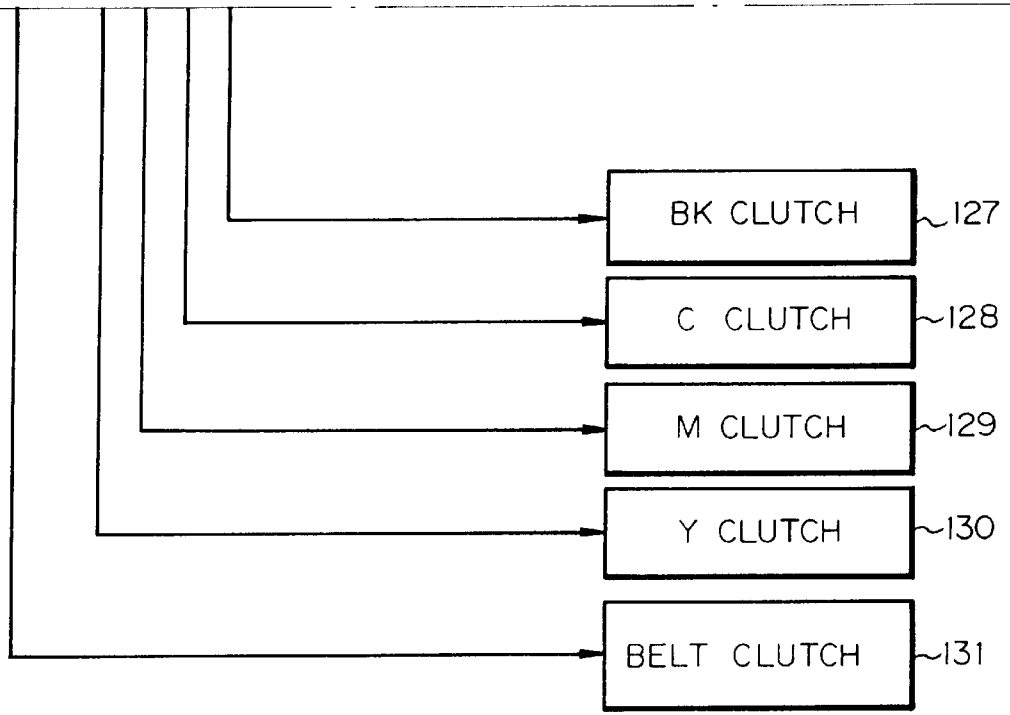

Referring to FIG. 2, a control system included in the illustrative embodiment is shown and includes a scanner motor 101 for driving the color scanner. A color CCD (Charge Coupled Device) 102 is representative of the color image sensor 17. Designated by the reference numeral 103 is a scanner controller. A system controller 104 controls the operation of the entire color copier. An image processing unit 105 executes conventional processing with the image data output from the scanner 10. A laser drive controller 106 controls a laser included in the writing unit 20. Images of different colors to be read are collectively designated by the reference numeral 107. There are also shown in FIG. 2 a polygon synchronization (sync) detector 108 and a polygon motor 109.

Further, a control panel 110 has various kinds of keys and a display arranged thereon. There are also shown an editor 111, the marker sensor 40, and other sensors 116. A Bk sleeve motor 121, a C sleeve motor 122, an M sleeve motor 123, a Y sleeve motor 124, a Bk clutch 127, a C clutch 128, an M clutch 129, a Y clutch 130 and a belt clutch 131 are connected to and controlled by the system controller 104. After the marker sensor 40 has sensed the marker 41, FIG. 1, of the belt 2, the system controller 104 selectively moves each developing unit toward or away from the drum 1 by controlling the sleeve motors 121–124 and clutches 127–130.

Figure 3:
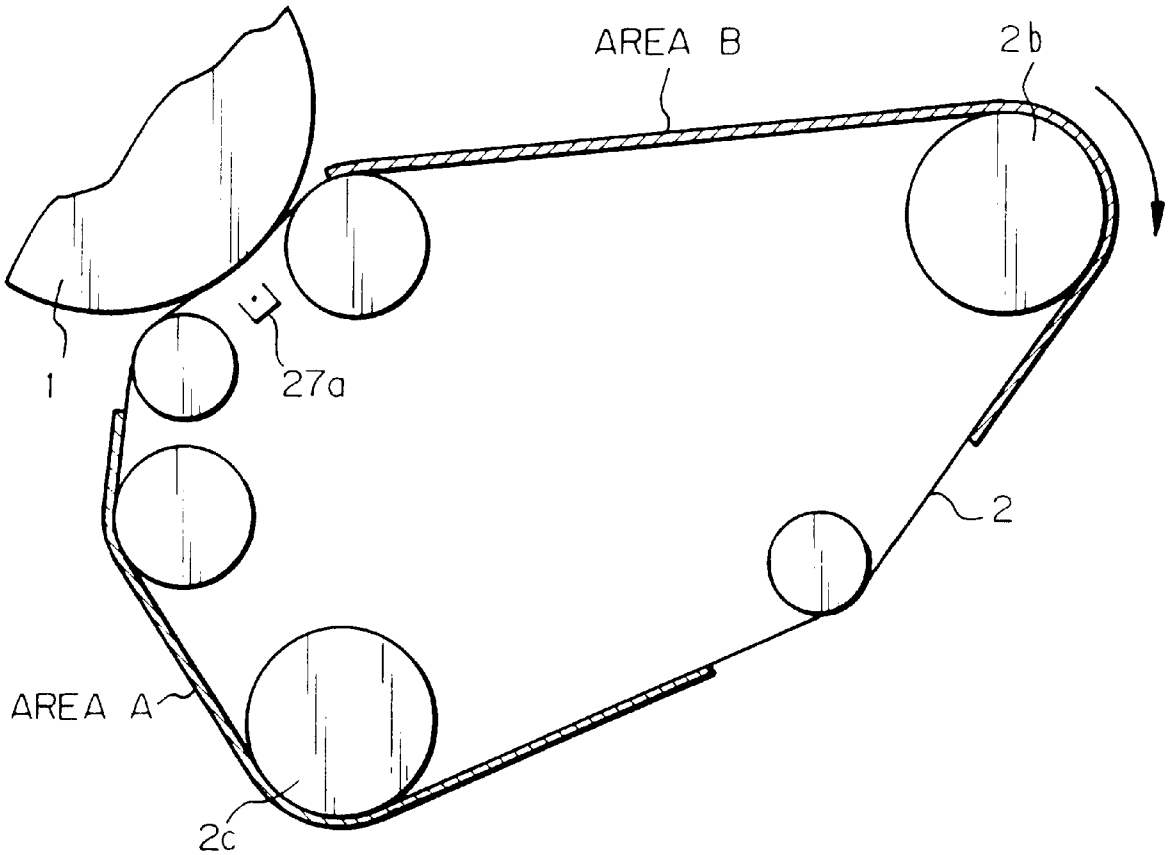
FIG. 3 shows how the illustrative embodiment transfers two images to separate areas of an intermediate transfer body.

FIG. 3 shows two composite toner images sequentially transferred from the drum 1 to the belt 2 by primary transfer in a continuous copy mode. As shown, when papers whose size is less than one-half of the maximum paper length usable with the color copier are selected, two toner images as small in size as the papers can be respectively formed in separate areas A and B of the belt 2 which are spaced in the circumferential direction of the belt 2. After the toner images in the areas A and B have been transferred to respective papers by secondary transfer, the belt cleaning unit 3, not shown, remove the toner left on the belt 2. Subsequently, next two toner images are transferred from the drum 1 to the belt 2. Such a procedure is also executed when three or more composite toner images are transferred from the drum 1 to the belt 2.

The operation of the above color copier will be described with reference to FIGS. 1 and 3. Assume that two composite toner images are respectively transferred to the separate areas A and B of the belt 2, as stated above. After the secondary transfer of the image from the area A to a single paper P, the next paper P is fed from the cassette 90 for transferring the image from the other area B. Assume that the paper sensor or sensing means 4*a*, 4*b* or 4*c* associated with the above cassette 90 does not sense any paper P at the time when the paper P for the transfer of the image of the area B should be fed. Then, the control section determines that a paper P for the image of the area B is absent. While a paper P of the same size and orientation as the above paper P may, of course, be fed from any other cassette 90 if present, assume that such a paper P is not present in the other cassettes 90. The toner image existing in the area B of the belt 2, as shown in FIG. 3, is formed by toner which is far greater in amount than the usual residual toner to be cleaned by the belt cleaning unit 3. Therefore, the toner forming the image in the area B is too great in amount to be fully removed by the usual cleaning ability of the belt cleaning unit 3. The toner left on the belt 2 despite the operation of the cleaning unit 3 would obstruct the accurate primary transfer of the next toner image from the drum 1 to the belt 2.

The illustrative embodiment solves the above problem with the following implementation. The paper sensing section 4 sends information representative of the absence of the expected paper P to the cleaning switching section 5. In response, the switching section 5 moves the developing units 26*b*–26*y* away from the drum 1 by controlling the sleeve motors 121–124 and clutches 127–130 (see FIG. 2) respectively assigned to the developing units 26*b*–26*y*, thereby interrupting the development. Subsequently, the switching section 5 releases the drum 1 and belt 2 from each other via the moving mechanism, not shown, so as to interrupt primary transfer. Further, the switching section 5 operates a drive motor, not shown, assigned to the belt 2 and the belt cleaning unit 3 in such a manner as to further enhance the cleaning ability. Specifically, the switching section 5 executes the cleaning operation over a range exceeding the entire circumferential length of the belt 2 and/or reduces the rotation speed of the belt 2. The switching section 5 may be implemented by the system controller 104, if desired.

Figure 4:
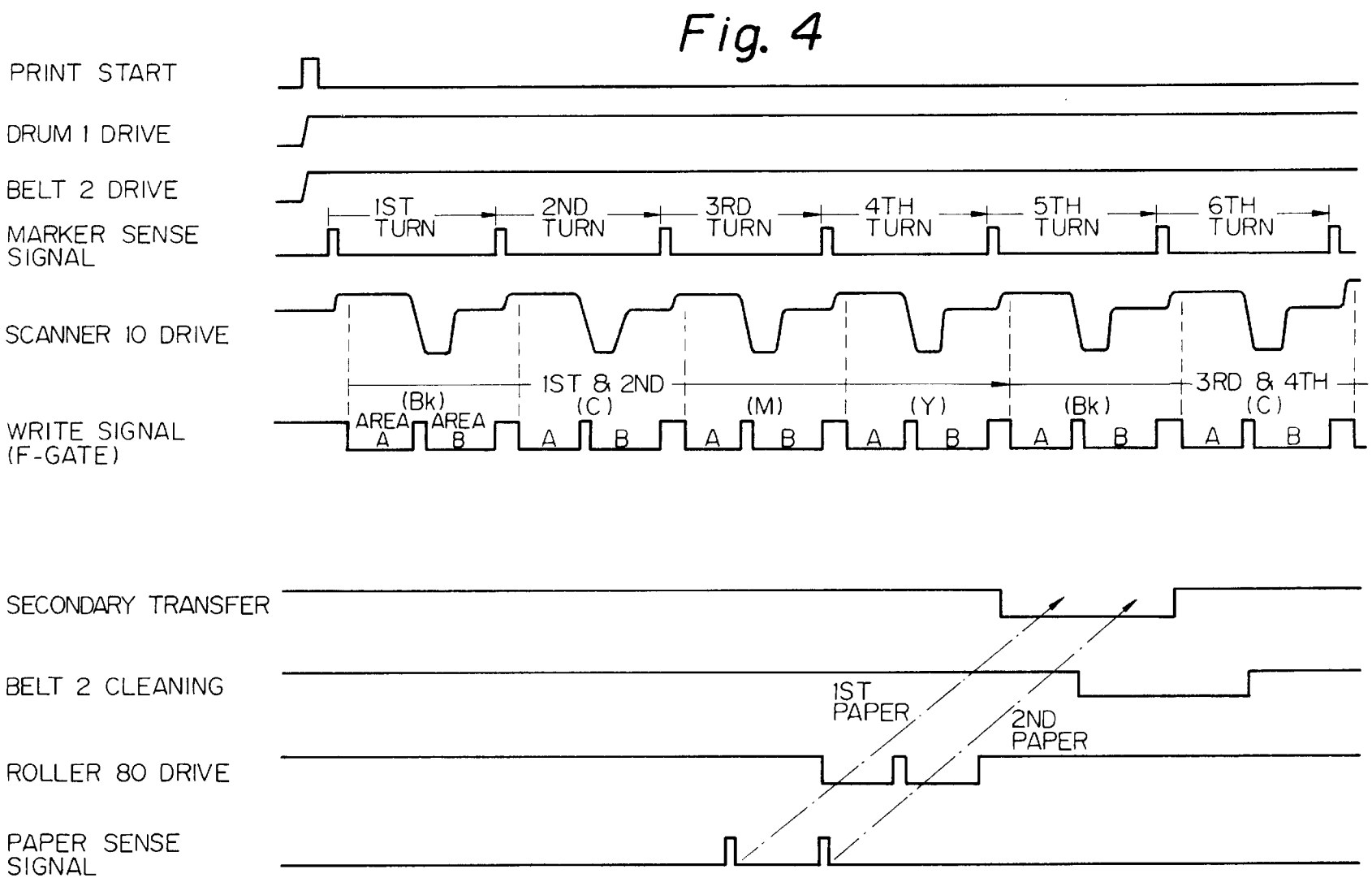
FIGS. 4 and 5 are timing charts each demonstrating a specific operation of the illustrative embodiment.

Reference will be made to FIG. 4 for describing the formation of two composite toner images in the continuous full-color copy mode more specifically. As shown, on the start of the printing operation, the drum 1 and belt 2 start rotating. The marker sensor 40 senses the marker 41 of the belt 2 being rotated. At the time when the output of the marker sensor 40 indicates the end of the fourth turn of the belt 2, the four colors Bk, C, M and Y have been fully written in the two areas A and B in accordance with a write signal (F-Gate).

Subsequently, the first and second papers P are sequentially fed from the cassette 90 toward the registration roller 80 in order to transfer composite toner images respectively formed in the areas A and B of the belt 2. The paper sensing section 4 outputs a paper sense output on sensing each of the two papers P. The registration roller 80 is so driven as to allow the images to be sequentially transferred from the two areas A and B of the belt 2 to the two papers P, respectively. As a result, the images of the areas A and B are respectively transferred to the two consecutive papers P by secondary transfer. On the elapse of a preselected period of time after the secondary transfer to the first paper, the belt cleaning unit 3 is driven to clean the belt 2.

Figure 5:
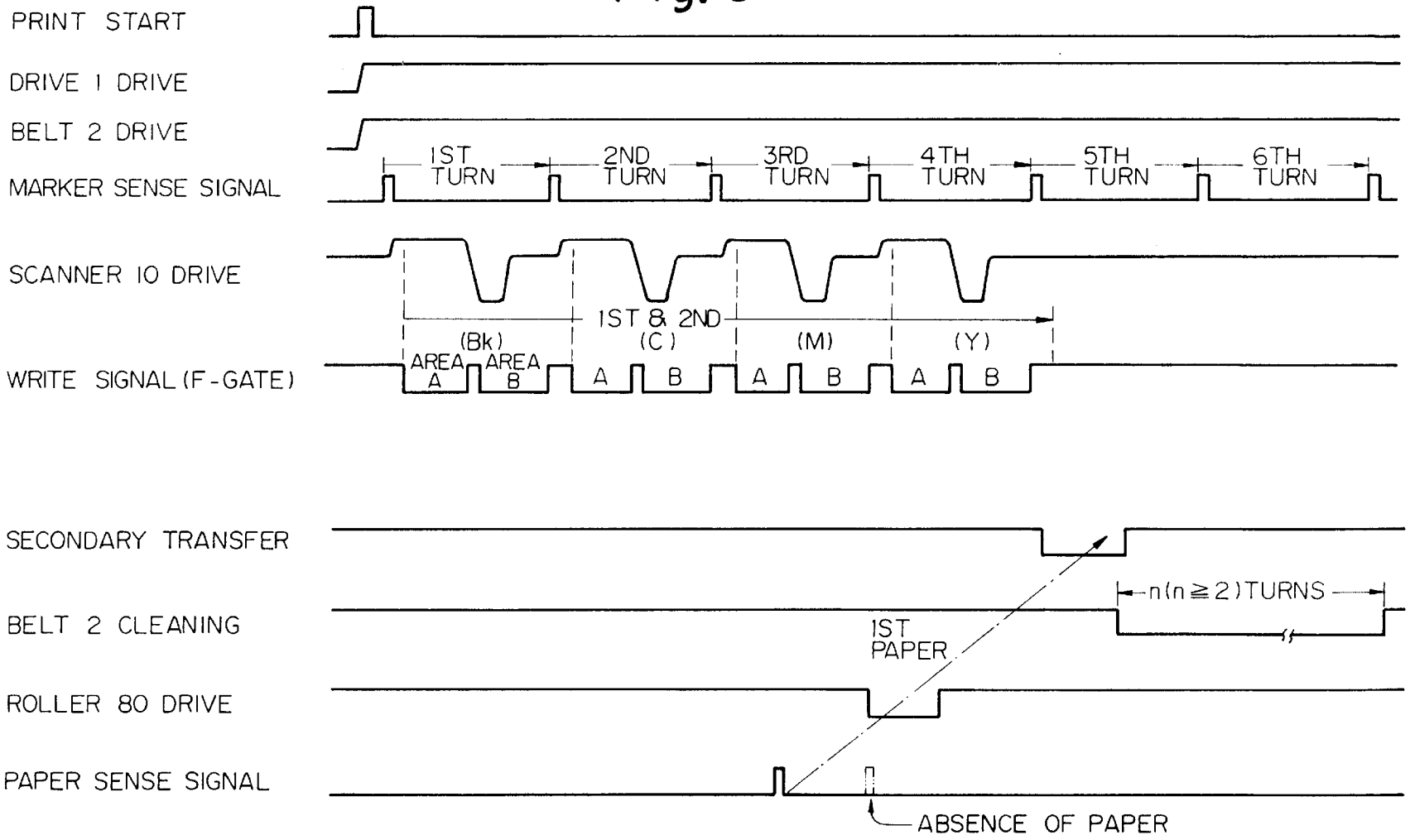

FIG. 5 shows a specific condition wherein the cassette 90 runs out of the papers P during the secondary transfer of the two images from the belt 2 to the two consecutive papers P shown in FIG. 4. As shown, the output of the paper sensing section 4 shows that the first paper has been successfully fed, but the second paper for the image of the area B is not fed. The registration roller 80 is driven in matching relation to the image of the area A with the result that the image of the area A is transferred to the first paper by secondary transfer. However, after the transfer of the image from the area A, another image is still present in the area B. The belt cleaning unit 3 would therefore fail to fully remove the toner constituting the image of the area B with its usual operation. In light of this, the cleaning unit 3 is continuously operated for two or more turns of the belt 2, i.e., for n turns ($n \geqq 2$) of the belt 2. Alternatively, if the rotation speed of the belt 2 is, e.g., halved, the cleaning unit 3 may be operated only for one turn of the belt 2, as shown in FIG. 4. Further, if the rotation speed of the belt 2 is reduced and if the cleaning unit 3 is continuously operated for two or more turns of the belt 2, a cleaning ability great enough to fully remove the toner left on the belt 2 will be achieved.

In summary, it will be seen that the present invention provides an image forming apparatus capable of fully removing a toner image from an intermediate transfer belt when a paper to which the toner image should be transferred is absent. It is therefore possible to produce attractive images continuously without interrupting the operation of the apparatus, i.e., only if papers are supplemented to the apparatus.

Various modifications will become possible for those skilled in the art after receiving the teachings of the present disclosure without departing from the scope thereof. For example, the present invention is practicable not only with a color copier shown and described, but also with a black-and-white copier of the type capable of forming a plurality of images in separate areas of an intermediate transfer body and sequentially transferring them to consecutive papers in a preselected order.

What is claimed is:

1. An image forming apparatus capable of sequentially transferring a plurality of toner images to respective areas of an intermediate transfer body separate in a circumferential direction of said intermediate transfer body, and sequentially transferring the plurality of toner images to respective recording media, said image forming apparatus comprising:

an image carrier for forming an image thereon;

said intermediate transfer body to which the toner image is transferred from said image carrier;

cleaning means for removing toner left on said intermediate transfer body;

medium sensing means for determining whether or not a recording medium for transferring the toner image existing on said intermediate transfer body is present;

interrupting means for interrupting, when said medium sensing means determines that the recording medium is absent, transfer of the toner image from said image carrier to said intermediate transfer body; and cleaning switching means for causing said cleaning means to clean said intermediate transfer body by a particular method different from a usual method, when said medium sensing means determines that the recording medium is absent.

2. An apparatus as claimed in claim 1, wherein the particular method includes cleaning said intermediate transfer body over an entire circumferential length of said intermediate transfer body and cleaning a portion of said entire circumferential length twice.

3. An apparatus as claimed in claim 2, wherein the particular method includes cleaning said intermediate transfer body when rotated at a reduced speed.

4. An apparatus as claimed in claim 1, wherein the particular method consists in cleaning said intermediate transfer body being rotated at a reduced speed.

5. An image forming apparatus capable of sequentially transferring a plurality of toner images to respective areas of an intermediate transfer body separate in a circumferential direction of the intermediate transfer body, and sequentially transferring the plurality of toner images to corresponding recording media, said image forming apparatus comprising:

an image carrier for forming a first toner image thereon;

said intermediate transfer body to which the first toner image is transferred from said image carrier;

cleaning means for removing toner left on said intermediate transfer body;

medium sensing means for determining whether a recording medium for a second toner image of said plurality of toner images is present; and enabling means for enabling transfer of said first toner image to a first recording medium;

inhibiting means for inhibiting transfer of said second toner image when said medium sensing means determines that a second recording medium for the second toner image is not present; and cleaning switching means for causing said cleaning means to clean said intermediate transfer body by a particular method different from a usual method when the second recording medium is not present, to remove said second toner image from said intermediate transfer body.

6. The apparatus of claim 5, wherein:

the particular method includes cleaning said intermediate transfer body over an entire circumferential length of said intermediate transfer body and cleaning a portion of said entire circumferential length twice.

7. The apparatus of claim 6, wherein:

the particular method includes cleaning said intermediate transfer body when rotated at a reduced speed.

8. The apparatus of claim 7, wherein:

the particular method includes cleaning said intermediate transfer body when rotated at a reduced speed.

9. An image forming apparatus comprising:

an image carrier configured to have a first toner image formed thereon;

an intermediate transfer body configured to receive said first toner image and simultaneously hold said first toner image and a second toner image;

a cleaning mechanism configured to contact said intermediate transfer body when operated in a cleaning mode of operation so as to remove toner from said intermediate transfer body during a cleaning mode of operation;

at least one sensor configured to determine a presence of a first recording medium on which said first toner image is to be transferred from said intermediate transfer body, and configured to determine a presence of a second recording medium on which the second toner image is to be transferred from the intermediate transfer body;

a controller configured to enable a transfer of the another toner image to the first recording medium, but to inhibit a transfer of the second toner image when the at least one sensor determines that the second recording medium is not present; and configured to initiate said cleaning mode of operation with a particular method different than a usual cleaning method when the at least one sensor determines that the second recording medium is not present so as to remove the second toner image from the intermediate transfer body.

10. The apparatus of claim 9, wherein:

the particular method includes cleaning said intermediate transfer body over an entire circumferential length of said intermediate transfer body and cleaning a portion of said entire circumferential length twice.

11. The apparatus as claimed in claim 10, wherein:

the particular method includes cleaning said intermediate transfer body when rotated at a reduced speed.

12. The apparatus as claimed in claim 9, wherein:

the particular method includes cleaning said intermediate transfer body when rotated at a reduced speed.

* * * * *